US008056166B2

(12) United States Patent
Calvert

(10) Patent No.: US 8,056,166 B2
(45) Date of Patent: Nov. 15, 2011

(54) PILLOW ADAPTED FOR MUSIC SYSTEM ENGAGEMENT AND USE IN THE PRONE OR SUPINE HEAD POSITION

(76) Inventor: Anthony Calvert, Santee, CA (US)

( * ) Notice: Subject to any disclaimer, the term of this patent is extended or adjusted under 35 U.S.C. 154(b) by 256 days.

(21) Appl. No.: 11/809,001

(22) Filed: May 30, 2007

(65) Prior Publication Data

US 2007/0277319 A1 Dec. 6, 2007

Related U.S. Application Data

(60) Provisional application No. 60/810,684, filed on Jun. 1, 2006.

(51) Int. Cl.
*A47C 20/00* (2006.01)

(52) U.S. Cl. ..... 5/638; 5/636; 5/639

(58) Field of Classification Search ..... 5/638, 636, 5/639, 645, 652.1
See application file for complete search history.

(56) References Cited

U.S. PATENT DOCUMENTS 3,315,282 A * 4/1967 Lowery et al. ..... 5/638
4,235,472 A * 11/1980 Sparks et al. ..... 5/638
5,076,405 A * 12/1991 Modica ..... 5/419
5,095,569 A * 3/1992 Glenn ..... 5/638
5,123,133 A 6/1992 Albert
5,819,346 A 10/1998 Lane
5,960,494 A * 10/1999 Gilliland et al. ..... 5/638
6,042,184 A * 3/2000 Kofoed ..... 5/638
6,128,797 A * 10/2000 Shaffer ..... 5/638
6,622,325 B1 9/2003 Garza
6,625,828 B2 9/2003 Matthews Brown
6,668,407 B1 12/2003 Reitzel
6,718,581 B2 4/2004 Riach
6,842,924 B1 * 1/2005 Walters ..... 5/637
6,922,860 B2 8/2005 Cuddy
6,957,497 B2 10/2005 Greenawalt et al.
7,287,528 B2 * 10/2007 Ho et al. ..... 128/206.21
2005/0177946 A1 * 8/2005 Riley ..... 5/638

* cited by examiner

*Primary Examiner* — Robert G Santos
*Assistant Examiner* — Brittany Wilson
(74) *Attorney, Agent, or Firm* — Donn K. Harms

(57) ABSTRACT

A pillow support for a user featuring an engageable pillow body to a base and at least one storage cavity formed therebetween. An aperture in the pillow body dimensioned to accommodate the face of a user positioned on the pillow communicates with a cavity in the base which communicates with air and light adjacent to the base to provide the user fresh air and light when face down. The storage cavity is adapted to hold a personal music player or phone and the pillow engages to the base with a strap or ridge surrounding the perimeter of the pillow.

6 Claims, 2 Drawing Sheets

PILLOW ADAPTED FOR MUSIC SYSTEM ENGAGEMENT AND USE IN THE PRONE OR SUPINE HEAD POSITION

FIELD OF INVENTION

This application claims priority from U.S. Provisional Patent Application Ser. No. 60/810,684 filed Jun. 1, 2006. The device herein described and disclosed relates generally to a pillow/audio system combination employing a pillow adapted for engagement and storage of a personal audio player. The pillow is also adapted in exterior shape and has depressions to provide comfort to the user in either the prone position or the supine position.

BACKGROUND

In the past, radios have been combined within pillows; however, such past efforts generally have paid little attention to the pillow and to the provision of comfort and proper positioning of the head of a user in either the prone (face down) or supine (face up) position. Such pillows generally have not provided shapes adapted to the facial construction of the user, nor pockets and cavities operatively sized and placed to accommodate modern digital music players and to protect them during transport of the pillow. It is important to the user to keep their head ergonomically supported while lying down for long periods of time to avoid neck pain subsequent to such a relaxing endeavor. Furthermore, previous pillow/radio combinations generally have provided little in the way of optional engageable speakers and the like that allow for the elimination of earphones which are known to cause hearing loss in users. Additionally, such pillow devices have not provided non-collapsible passages for air and light to reach the user in a face down position nor a base that is interchangeable with a plurality of pillow sections that may be adapted for face size.

Accordingly, there is an unmet need for a pillow device that is adapted to allow the comfortable prone positioning of a user's head and face during relaxation, such as on the beach, or around a pool. Such a device should provide passages for air and light to reach the face of the user to alleviate any fear of claustrophobia and to allow the face to remain cool and to provide continual fresh air to the facial cavity and user. Such a device should provide a base that is engageable to a plurality of pillow sections having a plurality of different dimensional characteristics to allow the device to adapt to different sized users and to allow for replacement of worn or otherwise soiled pillows.

Further, in the most preferred mode, such a device should also provide storage and operational positioning of music and audio players and wallets and the like, in an easy to access hidden pocket to keep valuables hidden and maintain the music player in the proximity of the head of the user. Such a device should also provide dimensional characteristics that allow for user comfort with proper ergonomic support while in the prone or supine position. Additionally, such a pillow/audio system combination must be easily engaged to a plurality of different digital music players and protect such players by enclosing them in padded compartments, with easy insertion access thereby eliminating obtrusive elements of the audio system projecting from the pillow during transport and use of the pillow.

SUMMARY OF THE INVENTION

There is disclosed and described herein a facial pillow support having a pillow component adapted for engagement to a base portion having non-collapsible arches providing for easy communication of light and air to a defined facial cavity in the bottom surface and center of the base which communicates with the pillow component. The base component is adapted about its perimeter edge to engage with the perimeter edge of one or multiple pillow components of the device.

An aperture communicating from a top surface of the pillow component to a bottom surface, is positioned to align with a passage communicating from the top surface of the base component to a central cavity formed in the bottom surface of the base portion. The cavity on the bottom surface provides a communication with light and air through at least one and preferably a plurality of arched slots formed through the sidewall of the base. A facial cavity is thereby formed by the engaged pillow and base and the aligned aperture and central cavity.

A user in the prone position is provided with this facial cavity which is adapted in shape to encircle the eyes and provide easy breathing through the nose. A chin recess formed by a slanted sidewall of the aperture in the pillow component provides chin support in the prone position. This slanted surface also provides excellent support to the neck and back portion of the head when the user is laying face up since the slant fits the slant on the lower portion of the rear of a human head.

As noted, the central cavity formed on the bottom surface of the base, in a particularly preferred mode of the device, includes one or a plurality of cutouts or slots which communicate through the side surfaces of the base to communicate fresh air and light into the facial recess. This communication is especially helpful in keeping the air in the facial cavity at a lower temperature and fully oxygenated for the user. Also, allowing some light into the cavity helps users avoid feelings of claustrophobia which many people experience when their eyes and nose are surrounded by a mask or cavity.

Also provided is a plurality of side accessible storage pockets formed into the base and extend below the bottom surface of the pillow component. The pockets are made easily accessible by the hand of the user through a curved recess in the perimeter edge of the top surface of the base component that are positioned to align with depressions formed in the top surface of the base component thereby allowing easy insertion of valuables such as a wallet or digital music players into the pockets.

The pocket or pockets are adapted to hold an Ipod, MP-3 player, or other personal musical device in a concealed engagement. Earphones communicate out the side of the side pocket of the device for engagement to the user's ears when lying down. The pockets formed into the top surface of the base component can also be employed to hold cell phones, digital cameras, other personal electronic devices, and even jewelry such as a watch or rings when storage might be desirable such as on a beach or at a pool when entering the water.

Additionally, the device provides comfortable support to the user's neck and head when in the supine position with the facial cavity providing a supporting recess for the generally projecting upper-rear portion of the user's head. The slanted upper surface also provides an excellent support to the neck in this position. Further, the disclosed device has exterior dimensional characteristics that provide for user comfort with proper ergonomic support while in the prone or supine position.

Optionally, in a particularly preferred mode of the device that protects the ears of the user from noise damage and provides a means to hear the user's surroundings, a pair of speakers may be employed and engaged to the device. The speakers would be in a flexible hinged engagement using a fabric hinge removably engaged to the surface of the pillow. The attachable speakers would thus provide another means to listen to the music instead of the earphones, protect the ears from damage from the earphones, and allow the user to monitor the sounds surrounding them which would not be heard when wearing the earphones.

The exterior of the pillow component in the preferred mode of the device is made from a soft, washable, cover and would be manufactured of a fabric such as velour or terrycloth towel material or a synthetic material that breathes such as polynosic rayon or fine weave nylon. The fabric cover would allow for customization for personal preferences and washing of the cover if soiled and the employed fabric will evaporate water or sweat during contact with the face. Polystyrene micro-beads are best employed as the filler for the pillow component as they do not absorb water and are particularly well adapted to easily conform to the shape of the face. Alternatively the pillow component may be a "self-skinning" polyurethane with open cell foam interior or of another fabric and interior that those skilled in the art might readily employ. The exterior skin whether foam or material should be soft when contacting the face of the user. The self-skinned exterior would not be susceptible to soiling and would provide a less expensive model of the device.

In this respect, before explaining at least one embodiment of the combination pillow audio enclosure invention in detail, it is to be understood that the invention is not limited in its application to the details of construction and to the arrangement of the components set forth in the following description or illustrated in the drawings. The invention is thus capable of other embodiments and of being practiced and carried out in various ways. Also, it is to be understood that the phraseology and terminology employed herein are for the purpose of description and should not be regarded as limiting.

As such, those skilled in the art will appreciate that the conception upon which the disclosed pillow device is based may readily be utilized as a basis for the designing of other methods and components for carrying out the several purposes of the present invention. It is important, therefore, that the claims be regarded as including such equivalent construction insofar as they do not depart from the spirit and scope of the present invention.

It is an object of this invention to provide an apparatus to support the head of a user comfortably in the prone position.

It is a further object of this invention to provide such a pillow apparatus that also is adapted to engage, store, and protect a digital or other personal music player.

An additional object of this invention is the provision of such a pillow that provides for fresh air and light to be communicated to the face of a user in the prone position.

A further object of this invention is the provision of a pillow with exterior dimensions to comfortably align the head of a user with their body when lying in the prone or the supine position.

Another object of this invention is the provision of a pillow which provides proper ergonomic support to a user while in the prone or supine position.

Yet another object of this invention is the provision of a pillow adapted to allow the use of a hidden music device encased in the pillow with earphones, or with engageable speakers.

A still further object of this invention is the provision of such a facial support that is customizable to the user's personal taste and facial structure with interchangeable pillow components adapted to engage a base.

These together with other objects and advantages which will become subsequently apparent reside in the details of the construction and method as more fully hereinafter described and claimed, reference being had to the accompanying drawings forming a part thereof, wherein like numerals refer to like parts throughout.

BRIEF DESCRIPTION OF THE DRAWING FIGURES

DETAILED DESCRIPTION OF PREFERRED EMBODIMENTS

Figure 1:
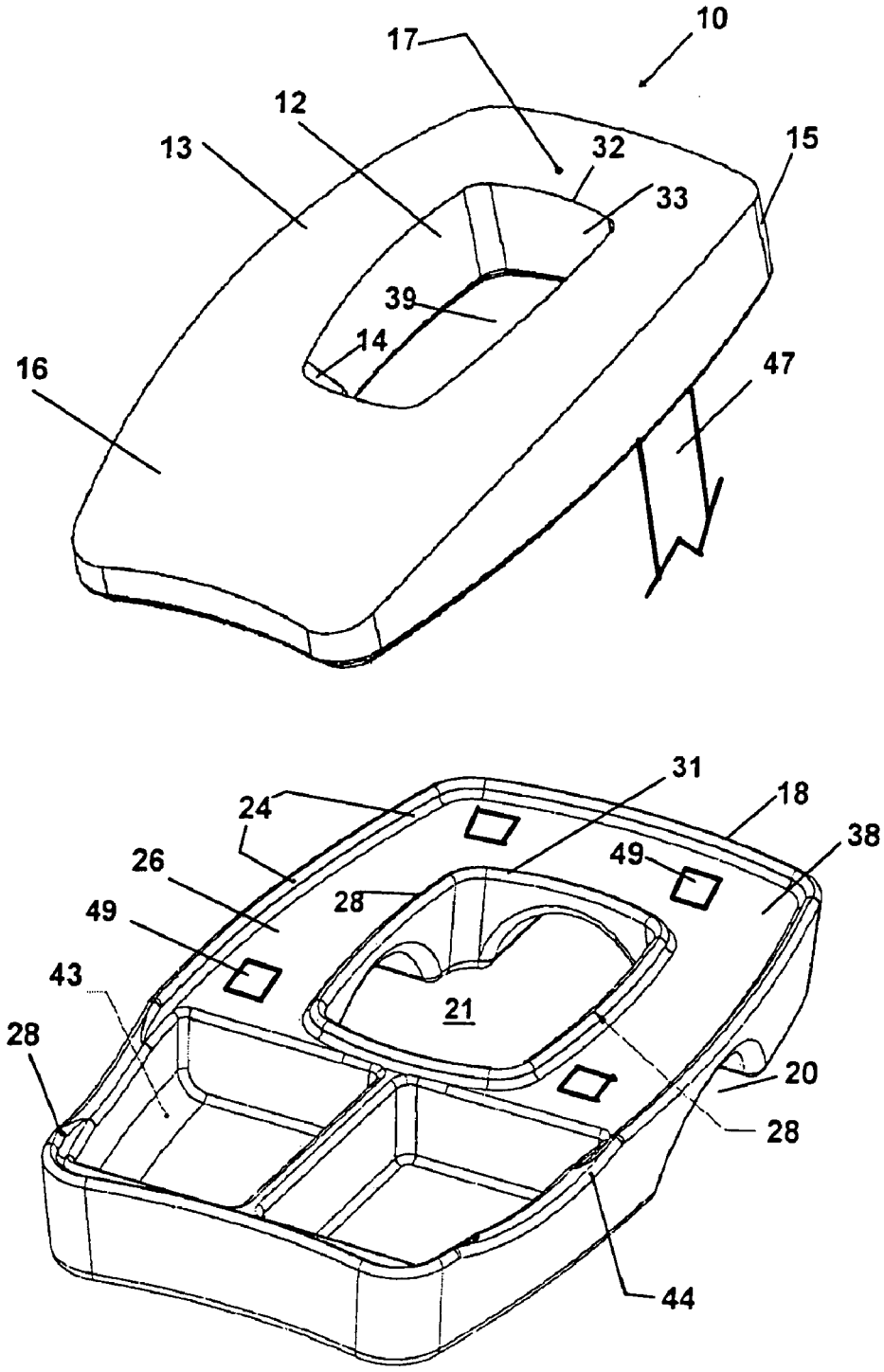
FIG. 1 depicts a perspective exploded view of the disclosed pillow device showing the pillow component and base component adapted to receive it.
Figure 3:
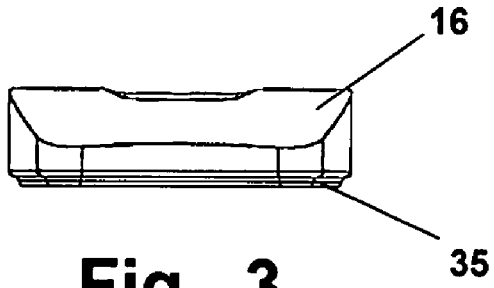
FIG. 3 is an end view showing the slant of the top surface of the pillow component adapting it to support the neck of the user.
Figure 4:
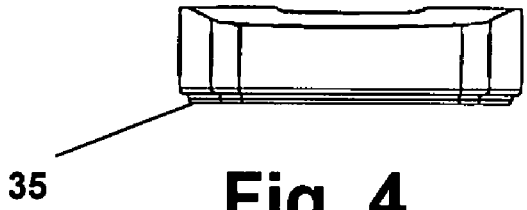
FIG. 4 shows another end view showing the top surface of the pillow adapted to support the forehead of the user.
Figure 2:
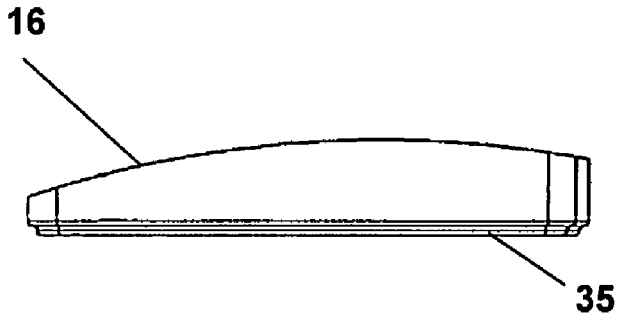
FIG. 2 depicts a side view showing the pillow component and bottom perimeter edge adapted to engage a co-operating perimeter on top of the base component.

Referring now to the drawings in FIGS. 1-5, the preferred embodiments of the present invention in current preferred modes are shown and described.

FIG. 1 depicts a side perspective exploded view of the disclosed pillow device 10. A facial recess 12 is formed in the top surface 13 of the pillow component 15 and adapted in size to encircle the eyes and projecting nose of the user to provide easy breathing through the nose. The slant formed on one side surface of the aperture provides a chin recess 14 which supports the chin of the user in the prone position. A slanted portion 16 of the top surface 13 of the pillow component 15 provides support to the neck when face down. A forehead slanted portion 17 provides additional comfort to the user in the prone position and is preferred.

A base component 18 is provided and formed of stiff foam or plastic or other material which provide support for non-collapsible slots 20 which communicate light and air to a formed central cavity 21 on the bottom surface of the base component 18. The slots 20 are shown in a particularly preferred mode in an arch for maximum support however other shapes can be employed and are anticipated. The exterior perimeter edge 24 of the top surface 26 of the base component 18 has a raised ridge 28 sized to engage with the outside perimeter of the bottom surface of the pillow component 15. A second raised ridge 28 is preferable positioned around the perimeter of a central aperture 31 in the top surface 26 of the base component 18. These two raised ridges 28 form a somewhat donut shaped depression in the top surface 26 which is particularly well adapted to provide a means for registered engagement of the pillow portion 15 on the top surface 26 of the base component 18 to maintain the aperture 32 of the pillow component 15 inline with the central aperture of the base component 15.

The aperture 32 of the pillow component 15 is dimensioned by a sidewall 33 which communicates from the top surface 13 of the pillow component 15 to a bottom surface 35. The aperture 32 is positioned to align with the central aperture 31 communicating from the upper surface 38 of the base component 18 to the central cavity 21 formed on the bottom surface of the base portion 18. The cavity 21 provides communication with light and air through at least one and preferably a plurality of the slots 20 formed through the sidewall of the base 18. The facial cavity 39 is thus defined by the engaged pillow component 15 with the base component 18 and the aligned aperture 32 and central cavity 21.

At least one and preferably a plurality of storage pockets 43 are formed into the top surface 26 of the base component 18 extending under the bottom surface 35 of the pillow component 15 when in registered engagement. The pockets 43 below the engaged pillow component 15 are accessible through slots 44 in the side of the base component 18 and which communicate through a sidewall and the raised ridge 28 and which are positioned to align with the pockets 43. The slots thereby allowing easy insertion of valuables such as a wallet or digital music players into the pockets 43 under the pillow portion 15 and allow for the hand or fingers of the user to communicate into the pocket 43 for retrieval.

At least one side pocket 43 is dimensioned to hold an IPOD or MP-3 player. Earphones (not shown) would engage with the musical device in the pocket 43 and communicate out the side of the device for engagement to the user's ears when lying down. The hidden pockets 43 also are adapted to hold and conceal cell phones, digital cameras, other personal electronic devices, and even jewelry such as a watch or rings when storage might be desirable such as on a beach or at a pool when entering the water.

Also in a very preferred mode of the device, a fixed removable engagement of the pillow component 15 to the base component 18 is desirable to keep them together during transport or rough usage. Employing such a means for removable engagement will allow the components of the device 10 to remain engaged when picked up by the pillow component 15 or tipped or transported and keep the pocket 43 covered to maintain the contents therein. Currently an elastic strap 47 can be employed around the bottom surface of the base component 18, or hook and loop cooperating component fabric 49 on the top surface of the base 18 and bottom surface 35 of the pillow component 18 would also work well.

The combination pillow and audio holding device shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described, may be employed for providing a device within the spirit of this invention.

As such, while the present invention has been described herein with reference to particular embodiments thereof, a latitude of modifications, various changes and substitutions are intended in the foregoing disclosure, and it will be appreciated that in some instances some features of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

What is claimed is:

1. A pillow apparatus comprising:

a pillow body having a top surface, a bottom surface, and a sidewall extending between an outside edge of said top surface and a perimeter edge defining a bottom surface;

an aperture in said pillow body defined by an aperture sidewall communicating between an inside edge of said top surface and said bottom surface, said aperture dimensioned to accommodate the face of a user when positioned on said top surface;

a base, said base having an upper surface defined by an upper perimeter and having a lower surface;

a base sidewall communicating between said upper surface and said lower surface;

at least one cavity communicating with said bottom surface of said base;

an opening communicating through said top surface of said base and said cavity;

at least one slot communicating with said cavity through said base sidewall;

means for engagement of said bottom surface of said pillow body upon said upper surface of said base in an engaged position;

said aperture being aligned with said opening when said pillow body is in said engaged position;

said aperture and said cavity defining a facial cavity when said pillow body is in said engaged position;

said slot providing means to communicate air and light to said facial cavity;

at least one storage cavity defined by a recess in said upper surface of said base, and said bottom surface of said pillow, with said pillow in said engaged position;

a slot communicating through said base sidewall with said storage cavity, said slot providing means to access said storage cavity when said pillow is in said engaged position;

said sidewall of said aperture having a slanted portion;

said slanted portion extending from a wider portion of said aperture adjacent to said top surface toward a narrower portion of said aperture adjacent to said bottom surface; and said slanted portion of said sidewall positioned to provide a support of a chin of a user when said pillow is in said engaged position with said face positioned on said top surface.

2. The pillow apparatus of claim 1 wherein means for engagement of said pillow body with said bottom surface supported on said upper surface of said base comprises:

a ridge extending above said upper surface of said base adjacent to and along said upper perimeter.

3. The pillow apparatus of claim 1 wherein means for engagement of said pillow body with said bottom surface supported on said upper surface of said base additionally comprises:

at least one strap extending from an outside edge of said pillow body through said slot to a connection with said pillow body adjacent to said aperture.

4. The pillow apparatus of claim 1 wherein means for engagement of said pillow body with said bottom surface supported on said upper surface of said base additionally comprises:

hook and loop fabric engaging said bottom surface to said upper surface.

5. A pillow apparatus comprising:

a pillow body having a top surface, a bottom surface, and a sidewall extending between an outside edge of said top surface and a perimeter edge defining a bottom surface;

an aperture in said pillow body defined by an aperture sidewall communicating between an inside edge of said top surface and said bottom surface, said aperture dimensioned to accommodate the face of a user when positioned on said top surface;

a base, said base having an upper surface defined by an upper perimeter and having a lower surface;

a base sidewall communicating between said upper surface and said lower surface;

at least one cavity communicating with said bottom surface of said base;

an opening communicating through said top surface of said base and said cavity;

at least one slot communicating with said cavity through said base sidewall;

means for engagement of said bottom surface of said pillow body upon said upper surface of said base in an engaged position;

said aperture being aligned with said opening when said pillow body is in said engaged position;

said aperture and said cavity defining a facial cavity when said pillow body is in said engaged position;

said slot providing means to communicate air and light to said facial cavity;

at least one storage cavity defined by a recess in said upper surface of said base, and said bottom surface of said pillow, with said pillow in said engaged position;

a slot communicating through said base sidewall with said storage cavity, said slot providing means to access said storage cavity when said pillow is in said engaged position;

a second storage cavity defined by a second recess in said upper surface of said base on an opposite side of said upper surface from said recess, and said bottom surface of said pillow, with said pillow in said engaged position; and a second slot communicating through said base sidewall at a position to communicate with said second storage cavity, said slot providing means to access said second storage cavity when said pillow is in said engaged position.

6. The pillow apparatus of claim 5 wherein means for engagement of said pillow body with said bottom surface supported on said upper surface of said base comprises:

at least one strap extending from an outside edge of said pillow body through said slot and said aperture to a connection with said pillow body, adjacent to said aperture.

* * * * *